US006493892B2

(12) United States Patent
Kang

(10) Patent No.: US 6,493,892 B2
(45) Date of Patent: Dec. 17, 2002

(54) MULTI-PURPOSE TOOL

(76) Inventor: Jaeyoul Kang, Hayan Village 609 Dong 806 Ho, 112 Gumi-Dong, Boondang-Ku, Sungnam City, Kyoungkido (KR)

( * ) Notice: Subject to any disclaimer, the term of this patent is extended or adjusted under 35 U.S.C. 154(b) by 0 days.

(21) Appl. No.: 09/793,500

(22) Filed: Feb. 27, 2001

(65) Prior Publication Data

US 2002/0062528 A1 May 30, 2002

(30) Foreign Application Priority Data

Nov. 28, 2000 (KR) ..... 00 33256

(51) Int. Cl.[7] ..... B25B 7/22
(52) U.S. Cl. ..... 7/137; 7/125; 7/130; 81/44
(58) Field of Search ..... 7/137, 125, 126, 7/127, 128, 130; 81/44, 27

(56) References Cited

U.S. PATENT DOCUMENTS 95,793 A * 10/1869 Granier ..... 7/137
114,665 A * 5/1871 Garrick ..... 7/125
276,793 A * 5/1883 Erdman et al. ..... 7/137
876,963 A * 1/1908 Hoak ..... 7/137
1,122,426 A * 12/1914 Schmitt ..... 7/137
4,403,725 A * 9/1983 Lawrence ..... 227/147
D281,216 S * 11/1985 Cutliff, Jr. et al. ..... D8/55
4,614,001 A * 9/1986 Liou ..... 7/137
4,953,248 A * 9/1990 Trombetta ..... 7/137
5,033,140 A * 7/1991 Chen et al. ..... 7/137
5,107,559 A * 4/1992 O'Reilley ..... 7/137
5,280,659 A * 1/1994 Park ..... 7/132
5,575,029 A * 11/1996 Simpson ..... 7/137

* cited by examiner

*Primary Examiner*—James G. Smith
*Assistant Examiner*—Hadi Shakeri
(74) *Attorney, Agent, or Firm*—Hoffman, Wasson & Gitler

(57) ABSTRACT

The present invention relates to a multi-purpose tool to perform various functions as one tool. More particularly, there is provided a multi-purpose tool including a number of features for various applications and uses. The tool can be used as a hammer, spanner, pincer, pliers, or a tool for holding and removing a concrete nail.

6 Claims, 3 Drawing Sheets

MULTI-PURPOSE TOOL

BACKGROUND OF THE INVENTION

1. Field of the Invention

The present invention relates to a holding tool which can be used for driving a nail. More particularly, the invention relates to a multi-purpose tool which can be used as a hammer, a spanner, a pincer, pliers, or a tool for holding and removing a concrete nail.

2. Discussion of Related Art

Generally, all kinds of tools, such as a tool to drive a concrete nail, a hammer, a spanner, a pincer, a driver, and pliers are needed in the field of industry, or at home. Conventional tools with one function have been the cause of diminution of work efficiency, since each tool needs to be stored separately and looked for whenever needed. Recently many different kinds of multi-purpose tools have been developed to enable one tool to perform various functions. However, these conventional multi-purpose tools could be used for only two or three functions. That is, they were made to perform similar functions such as a hammer and a pincer; or pliers, a wire cutter, and a wire stripper, and were not able to perform multiple functions at once as one tool. As a result, to work in the field of industry or at home, various kinds of tools need to be prepared, stored separately, and looked for whenever necessary, which delayed work speed and therefore caused lower efficiency.

SUMMARY OF THE INVENTION

The present invention has been studied and developed to solve the traditional problems described above. The objective of this invention is to improve the efficiency by adding various functions to a concrete nail driver so that it can have multiple functions. Therefore, one tool does all the work, saving the trouble of keeping each tool in separate places and searching for each of them whenever needed.

It is another object of the present invention to make the storage and carrying of the tool convenient by minimizing the tool size even though various functions are combined into one tool.

BRIEF DESCRIPTION OF THE ATTACHED DRAWINGS

DETAILED DESCRIPTION OF PREFERRED EMBODIMENT

Figure 1:
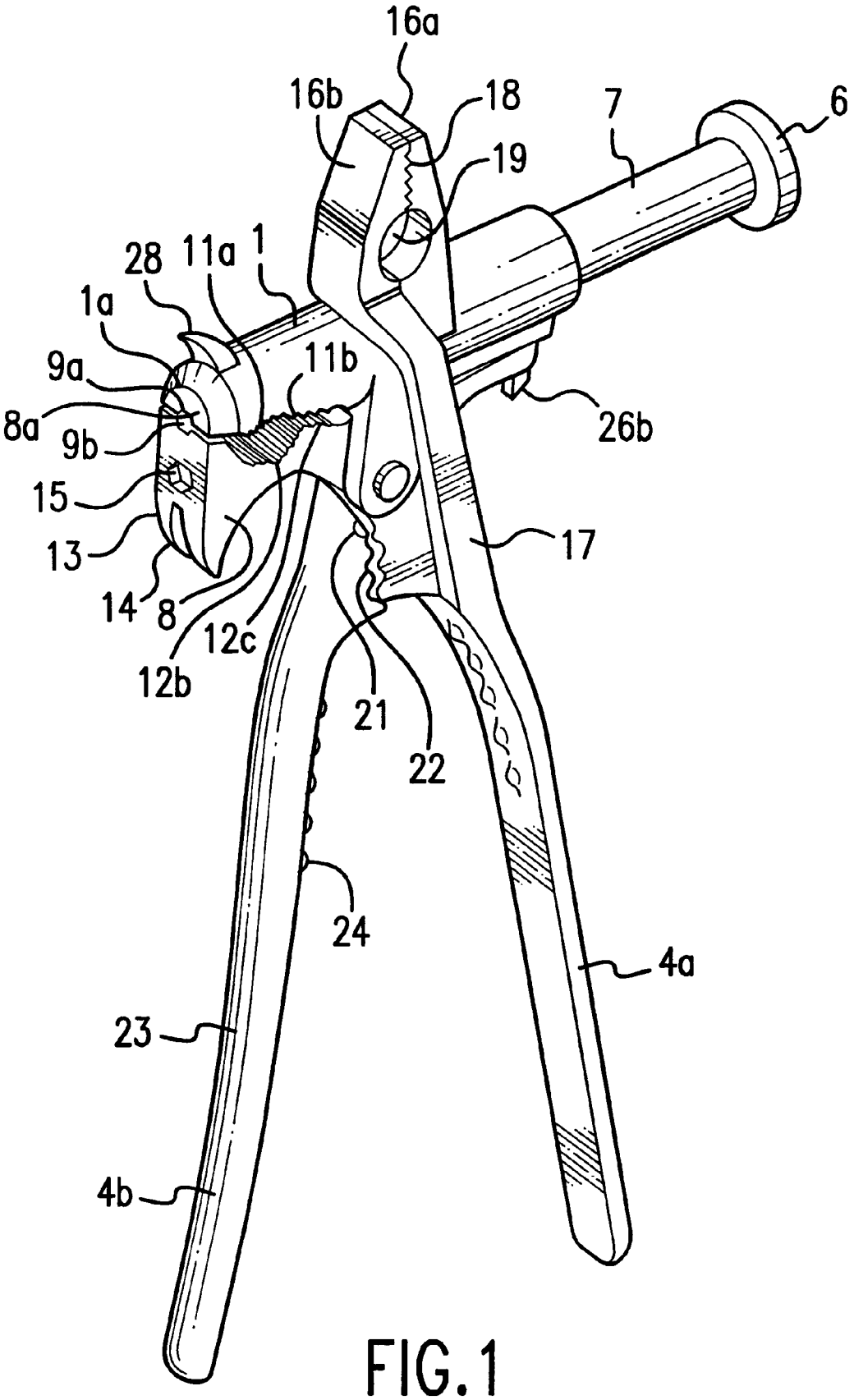
FIG. 1 is a perspective view of a tool according to the present invention.
Figure 2:
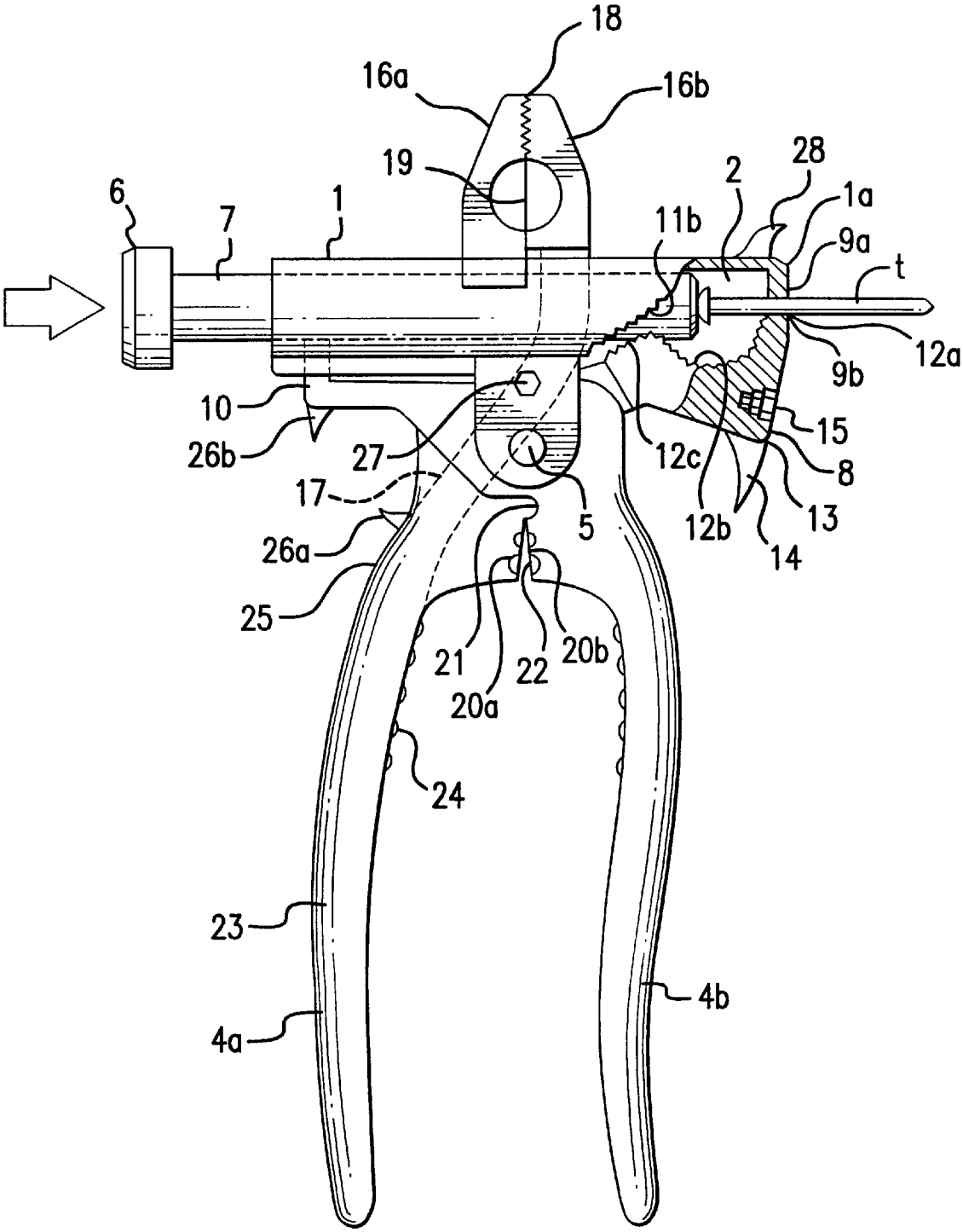
FIG. 2 is a partly cut side view of a tool according to the present invention that shows the using state of a tool.
Figure 3:
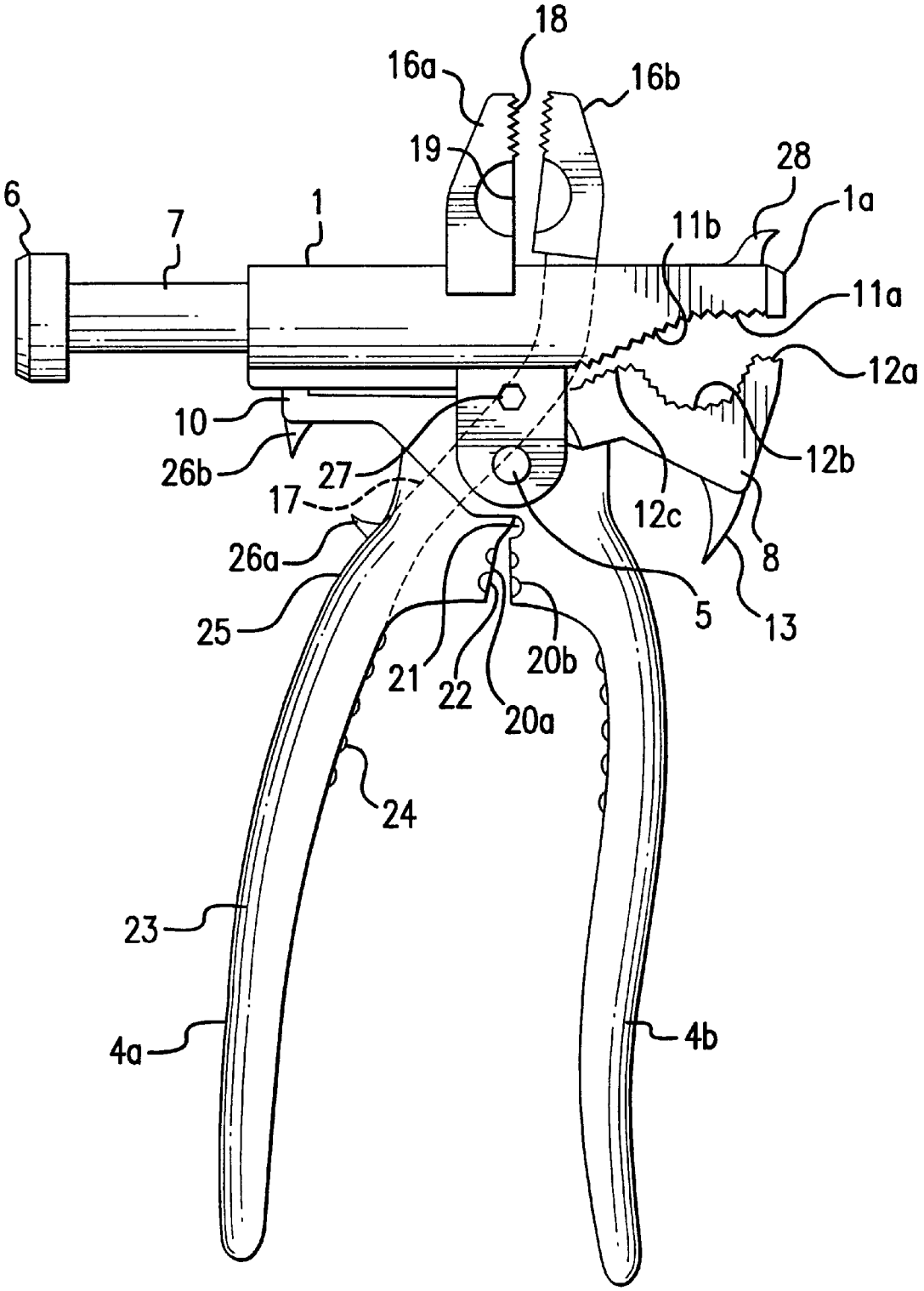
FIG. 3 is a side view of a tool according to the present invention when a left handle is opened.

FIG. 1 is a perspective view of the present invention, FIG. 2 is a partly cut side view showing the using state of the tool, and FIG. 3 is a side view of the tool when a left handle is opened.

In the present invention, as described in FIG. 1, a monolithic bearing is formed at the lower part of the body 1 which is equipped with a chamber 2 inside. The axis 5 is fixed at the bearing anchor point. Left and right handles 4*a*, 4*b* are installed so that they can move freely left and right. A rod 7 having a hammer head 6 at one end is joined to the inside of the chamber 2 so that it can move left and right.

At the upper right corner of the left handle 4*a*, lower jaw 8 is monolithically formed. At the upper part 8*a* of the lower jaw 8 and at the side 1*a* of the body 1 a holding groove 9*a*, 9*b* that supports concrete nails are formed, respectively. A catching part 10 projecting from at the upper left corner of the right handle 4*b* is joined to penetrate the chamber 2 so that the rod 7 can be closely supported by the end of the catching part 10.

Also, at the lower end of the side 1*a* of the body 1, straight line teeth 11*a* and sloping teeth 11*b* are formed. At the upper side of the lower jaw 8, straight line teeth 12*a*, U-shaped teeth 12*b*, and sloping teeth 12*c* are formed, respectively so that the tool can function as a spanner, a pipe wrench and tweezers.

Along the lower part of the lower jaw 8, a claw 13 is formed with a groove 14 in the center to pull out a nail so that it can function as a pincer. A hexagonal groove 15 at the side of the lower jaw 8 so that the tool can perform the upholding function of a bar spanner.

At the upper side of the body 1, a pliers-fixing-head 16*a* is attached. At the end of an extension 17 extending from the upper part of the left handle 4*a*, a pliers-freely moving-head 16*b* is formed. The pliers-fixing-head 16*a*, and the pliers-freely moving-head 16*b*, have opposed teeth 18 and a cross section 19 so that the tool can function as pliers.

Furthermore, at the lower part of the axis 5 of right and left handles 4*a*, 4*b*, moving plates 20*a*, 20*b* are formed. A cutting part 21 is formed at the upper part of the moving plate 20*a*, and electric wire holes 22 are formed in various sizes at the lower part of the moving plate 20*a*, 20*b* so that the tool can perform the function of wire cutting and wire stripping.

In addition, several catching projections 24 are formed on the inside of the upper part of the left and right handles 4*a*, 4*b* so that they can function as a screwed type bottle opener. At the shoulder part 25 of the left handle 4*a*, a lower catching projection 26*a* is formed to project upward and at the end of the upper left side of the right handle 4*b*, on upper catching projection 26*b* is formed to project downwardly so that the tool can perform the function as a crown type bottle opener.

Also, a joint hole 27 is formed by punching on the bearing so that the hexagonal upholding part of a screwdriver can be inserted.

Also, a striking part 28 is formed to project upwardly from the side 1*a* of the body 1 so that it can function as a window breaker.

An operating method of the above described invention is now described.

As illustrated in FIG. 2 of this invention, in order to drive a concrete nail t, the nail is held by the holding groove 9*a*, 9*b* and the left handle 4*a* is pushed toward the right handle. Then the lower jaw 8 applies pressure to the side 1*a* and concrete nail t is firmly held at the holding grooves 9*a*, 9*b*, so that the end of the concrete nail t, or the side 1*a* of the body 1, is closely held to the concrete wall. When a hammer head of a separate hammer hits the hammer head 6, the inertia of the hammer is transferred to the concrete nail through the rod 7 and drives it into the concrete wall. This operation of driving a nail can be done with less force without the nail getting bent because the concrete nail is closely held by the holding groove 9*a*, 9*b* and the inertia of hammer is concentrated as it is provided straightforward through the rod 7.

Also, this tool can be used as a spanner, a pipe wrench, and tweezers by using straight teeth 11*a* and sloping teeth

11*b* formed at the lower end of the side 1*a* of the body 1 and straight teeth 12*a*, U-shaped teeth 12*b*, and sloping teeth 12*c* formed at the upper side of the lower jaw 8. Between each sloping teeth 11*b*, 12*c*, a hexagonal bolt head or a nut can be located and when the left handle 4*a* is moved toward the right handle, the lower jaw 8 applies pressure to the side 1*a* and the bolt or a nut is closely held by each of the straight teeth 11*b*, 12*c*. Therefore, it can be used as a spanner to fasten or disjoint a bolt or a nut.

It also can be used as a pipe wrench because the upper part of the pipe is caught by the straight teeth 11*a* and sloping teeth 11*b* and the lower part of the pipe is caught by U-shaped teeth 12*b*. This tightly holds the pipe, and it can function as tweezers if various kinds of objects are placed and held between the straight teeth 11*a*, 12*a*.

In order to use this tool as pliers, the left handle 4*a* is moved away from the right handle. A gap is formed as it is moved away from the axis 5 and the pliers-freely moving-head 16*b* is separated from the pliers-fixing-head 16*a*. Once various kinds of objects are placed in the gap, the left handle 4*a* is pressed toward the right handle and the pliers-freely moving-head is held closely to the object, which makes the holding or cutting function possible.

Also, if the left handle 4*a* is moved toward the right handle, the cutting part 21 and the electric wire hole 22 formed on the moving plate 20*a*, 20*b* are separated. Therefore, wire to be cut or electric wire to be stripped is placed at the cutting part 21 or on the wire hole 22 and the left handle 4*a* is pressed toward the right handle so that the wire placed at the cutting part 21 can be cut and the cover of the electric wire placed on the wire hole 11 can be stripped.

Also, to open a threaded bottle cap, the periphery of a bottle cap is tightly gripped by the catching projections 24 formed inside the holding unit 23 of left and right handles 4*a*, 4*b* and the cap is rotated while pressing the left handle toward the right handle.

Also the tool can be used to pull out a nail by holding the head of nail resting in the groove 14 and using the claw 13.

Also heads of the various kinds of bar spanners or box spanners can be joined to the hexagonal groove 15 as a bolt is fastened or disjointed by inserting the end of the bar spanner in the hexagonal groove 15 and combining a striking end to the head of a bolt.

Furthermore, the tool can be used to fasten or loose a screw when the head of a screwdriver is inserted to the joint hole 27.

Also, if the tool of the present invention is kept in a car and to be used to break a window for passengers to escape in case of emergency. One can break a window with less force by using the sharp end of the striker 28.

As described above, the present invention is to develop a tool that can function as a spanner, pliers, a pincer, a can opener, a wire cutter, an electric wire stripper, and a window breaker as well as a concrete nail driver. This will improve the work efficiency by shortening the working hour because many different kinds of functions can be performed by one tool. This eliminates the complication of keeping tools with different functions separately and of searching for them each time they are needed.

Also, despite that various functions are organized into one tool, the size of the tool does not getting bigger and can be minimized so that the storage and carrying is convenient.

Moreover, the present invention is a useful invention in that it does not have a defect part and the necessary functions of tools are constructed compositively so that it can be conveniently used both in the field of industry or at home.

What is claimed:

1. A multipurpose tool, comprising:

a body having a left side and a right side, a rod slidably retained in said body and extending from the left side of said body, said rod having a hammer head at one end, a lower jaw located below the right side of the body and movable relative to the body, a first set of teeth formed in a lower surface of the right side of the body, a second set of teeth formed in an upper surface of the lower jaw, a first groove formed in a lower surface of the right side of the body, a second groove formed in an upper surface of the lower jaw, said first and second groove cooperating to hold a nail, a right handle extending downwardly from the body, said right handle having a first moving plate, a left handle extending downwardly from said body, said left handle having a second moving plate, an extension extending from the left handle terminating in a pliers-freely moving-head located above the body, and a pliers fixing head attached to and extending above said body and cooperating with said pliers-freely moving-head to grasp items.

2. The multipurpose tool of claim 1, further comprising a wire cutter and wire strippers formed in the first and second moving plates.

3. The multipurpose tool fo claim 2, further comprising projections formed on the left handle and the inner surface of the right handle for grasping threaded closures.

4. The multipurpose tool of claim 1, further comprising:

a catching part extending from the right handle and extending to the left side of the body, a first catching projection extending downward from the catching part, a second catching projection extending upward from the left handle, and the first and second catching projections cooperating to form a bottle opener.

5. The multipurpose tool of claim 1, further comprising:

a claw extending downward from the lower jaw, and a groove in the claw for grasping a nail.

6. The multipurpose tool of claim 1, further comprising a striker extending upwardly from the right side of the body for breaking a window.

* * * * *